US010344636B2

(12) United States Patent
Hashimoto

(10) Patent No.: US 10,344,636 B2
(45) Date of Patent: Jul. 9, 2019

(54) SINTERED VALVE SEAT AND ITS PRODUCTION METHOD

(71) Applicant: KABUSHIKI KAISHA RIKEN, Tokyo (JP)

(72) Inventor: Kimiaki Hashimoto, Kumagaya (JP)

(73) Assignee: KABUSHIKI KAISHA RIKEN, Tokyo (JP)

( * ) Notice: Subject to any disclaimer, the term of this patent is extended or adjusted under 35 U.S.C. 154(b) by 182 days.

(21) Appl. No.: 15/321,645

(22) PCT Filed: Jun. 17, 2015

(86) PCT No.: PCT/JP2015/067414

§ 371 (c)(1),
(2) Date: Dec. 22, 2016

(87) PCT Pub. No.: WO2015/198932

PCT Pub. Date: Dec. 30, 2015

(65) Prior Publication Data

US 2017/0145875 A1 May 25, 2017

(30) Foreign Application Priority Data

Jun. 27, 2014 (JP) ..... 2014-132301

(51) Int. Cl.
*F01L 3/02* (2006.01)
*C22C 9/00* (2006.01)
(Continued)

(52) U.S. Cl.
CPC ..... *F01L 3/02* (2013.01); *B22F 1/0003* (2013.01); *B22F 3/16* (2013.01); *B22F 5/008* (2013.01);
(Continued)

(58) Field of Classification Search
CPC ..... B22F 1/0003; B22F 2304/10; B22F 2301/15; B22F 2301/35; B22F 2301/10;
(Continued)

(56) References Cited

U.S. PATENT DOCUMENTS 5,004,581 A 4/1991 Takagi et al.
5,125,962 A 6/1992 Krentscher
(Continued)

FOREIGN PATENT DOCUMENTS

CN 1042948 A 6/1990
CN 1932057 A 3/2007
(Continued)

OTHER PUBLICATIONS

First Office Action dated Jan. 19, 2018, in Chinese Patent Application No. 201580034132.9, with English translation.
(Continued)

*Primary Examiner* — Craig J Price
*Assistant Examiner* — Andrew J Rost
(74) *Attorney, Agent, or Firm* — Birch, Stewart, Kolasch & Birch, LLP

(57) ABSTRACT

To provide a press-fit, sintered valve seat having high valve coolability and wear resistance for use in a high-efficiency engine, and its production method, Cu powder having an average particle size of 45 μm or less and purity of 99.5% or more is used to form a network-connected Cu matrix, even though a relatively large amount of hard Co-based alloy particles are added; and Fe—P alloy powder is used for densification by liquid-phase sintering.

6 Claims, 4 Drawing Sheets

(51) Int. Cl.

| | |
|---|---|
| ***C22C 9/06*** | (2006.01) |
| ***C22C 19/07*** | (2006.01) |
| ***B22F 1/00*** | (2006.01) |
| ***B22F 3/16*** | (2006.01) |
| ***B22F 5/00*** | (2006.01) |
| ***C22C 38/00*** | (2006.01) |
| ***C22C 1/04*** | (2006.01) |

(52) U.S. Cl.
CPC ..... *C22C 1/0425* (2013.01); *C22C 1/0433* (2013.01); *C22C 9/00* (2013.01); *C22C 9/06* (2013.01); *C22C 19/07* (2013.01); *C22C 38/002* (2013.01); *B22F 2301/10* (2013.01); *B22F 2301/15* (2013.01); *B22F 2301/35* (2013.01); *B22F 2304/10* (2013.01); *B22F 2998/10* (2013.01)

(58) Field of Classification Search
CPC ..... B22F 2998/10; B22F 5/008; B22F 3/16; C22C 38/002; C22C 19/07; C22C 9/00; C22C 9/06; C22C 1/0425; C22C 1/0433; F01L 3/02
See application file for complete search history.

(56) References Cited

U.S. PATENT DOCUMENTS

| | | | | |
|---|---|---|---|---|
| 5,975,039 | A | 11/1999 | Oshige | |
| 6,039,785 | A | 3/2000 | Dalal et al. | |
| 6,679,933 | B1 * | 1/2004 | He | C22C 32/0084 419/11 |
| 6,793,876 | B2 | 9/2004 | Kawakami et al. | |
| 7,666,246 | B2 | 2/2010 | Matsuki et al. | |
| 7,811,511 | B2 | 10/2010 | Matsuki et al. | |
| 2004/0131492 | A1 | 7/2004 | Kawakami et al. | |
| 2007/0057238 | A1 | 3/2007 | Matsuki et al. | |
| 2010/0104466 | A1 | 4/2010 | Matsuki et al. | |

FOREIGN PATENT DOCUMENTS

| | | | |
|---|---|---|---|
| JP | 3-60895 | A | 5/1991 |
| JP | 3-502216 | A | 5/1991 |
| JP | 7-119421 | A | 5/1995 |
| JP | 10-184324 | A | 7/1998 |
| JP | 2001-500567 | A | 1/2001 |
| JP | 2004-124162 | A | 4/2004 |
| JP | 2007-77438 | A | 3/2007 |

OTHER PUBLICATIONS

International Search Report issued in PCT/JP2015/067414, dated Sep. 15, 2015.
Written Opinion of the International Searching Authority issued in PCT/JP2015/067414 (PCT/ISA/237), dated Sep. 15, 2015.

* cited by examiner

Cr-Kα

Co-Kα

Mo-Kα

P-Kα

Fe-Kα

Cu-Kα

SINTERED VALVE SEAT AND ITS PRODUCTION METHOD

FIELD OF THE INVENTION

The present invention relates to an engine valve seat and its production method, particularly to a press-fit, high-thermal-conductivity, sintered valve seat capable of suppressing the temperature elevation of a valve and its production method.

BACKGROUND OF THE INVENTION

To provide automobile engines with improved fuel efficiency and higher performance for environmental protection, recently, so-called downsizing which reduces engine displacement by 20-50% is accelerated, and direct-injection engines are combined with turbochargers to increase compression ratios. Improvement in the efficiently of engines inevitably results in higher engine temperatures, which may cause power-decreasing knocking. Accordingly, improvement in the coolability of parts particularly around the valves has become necessary.

As a means for improving coolability, JP 7-119421 A discloses a method for producing an engine valve comprising sealing metal sodium (Na) in a hollow portion of a hollow valve stem. JP 3-60895 A teaches a method for directly buildup-welding a valve seat on a cylinder head of an aluminum (Al) alloy by high-density heating energy such as laser beams, which is called "laser clad method." An alloy for buildup-welding the valve seat is a dispersion-strengthened Cu-based alloy comprising boride and silicide particles of Fe—Ni dispersed in a copper (Cu)-based matrix, Sn and/or Zn being dissolved in primary Cu-based crystals.

The valve temperature during the operation of an engine is about 150° C. lower in the above sodium-filled valves (valve temperature: about 600° C.) than in solid valves, and the Cu-based alloy valve seats produced by the laser clad method lowers the solid valve temperature by about 50° C. (valve temperature: about 700° C.), preventing knocking. However, the sodium-filled (Na-enclosed) valves suffer a high production cost, so that they are not used widely except some vehicles. The Cu-based alloy valve seats produced by the laser clad method, which do not contain hard particles, have insufficient wear resistance, suffering seizure by impact wear. Also, the direct buildup-welding on cylinder heads needs the drastic change of cylinder head production lines and large facility investment.

To improve the thermal conductivity of a valve seat press-fit into a cylinder head, JP 10-184324 A discloses a two-layer structure comprising a valve-abutting layer containing Cu powder or Cu-containing powder (Cu content: 3-20%) and a valve seat body layer (Cu content: 5-25%), and JP 2004-124162 A discloses the infiltration of Cu or a Cu alloy into a sintered Fe-based alloy in which hard particles are dispersed.

JP 2001-500567 A discloses a sintered Cu-based alloy valve seat made of a dispersion-hardened Cu-based alloy having excellent thermal conductivity, in which hard particles are dispersed. Specifically, it teaches a starting material powder mixture comprising 50-90% by weight of main Cu-containing powder and 10-50% by weight of additional Mo-containing alloy powder, the Cu-containing powder being Cu powder hardened by dispersed $Al_2O_3$, and the Mo-containing alloy powder comprising 28-32% by weight of Mo, 9-11% by weight of Cr, and 2.5-3.5% by weight of Si, the balance being Co.

Though JP 2001-500567 A teaches that the Cu powder dispersion-hardened by $Al_2O_3$ can be produced by atomizing a Cu—Al alloy melt to Cu—Al alloy powder, and heat-treating the atomized Cu—Al alloy powder in an oxidizing atmosphere to selectively oxidize Al, it is actually difficult to increase the purity of a Cu matrix in which $Al_2O_3$ formed from an Al-dissolved Cu—Al alloy is dispersed.

OBJECT OF THE INVENTION

In view of the above problems, an object of the present invention is to provide a press-fit, sintered valve seat having high valve coolability and wear resistance for use in a high-efficiency engine, and its production method.

DISCLOSURE OF THE INVENTION

As a result of intensive research on a sintered valve seat comprising hard particles dispersed in a Cu-based alloy having excellent thermal conductivity, the inventor has found that the use of finer Cu powder having predetermined purity than the hard particles makes it possible to form a network-like Cu matrix even with a relatively large amount of hard particles added, and that with this technology combined with liquid-phase sintering, a press-fit, sintered valve seat having excellent wear resistance and high valve coolability while keeping high thermal conductivity of a Cu matrix can be obtained.

Thus, the sintered valve seat of the present invention has hard Co-based alloy particles dispersed in a Cu matrix; the sintered valve seat comprising by mass 2.1-6.0% of Fe, and 0.8-2.2% of P, in addition to components forming the Cu matrix and the hard particles. The sintered valve seat preferably further comprises 5% by mass or less of Ni.

The hard particles are preferably of a Co—Mo—Cr—Si alloy or a Co—W—Cr—C alloy having an average particle size of 5-100 μm. The Co—Mo—Cr—Si alloy preferably comprises by mass 27.5-30.0% of Mo, 7.5-10.0% of Cr, and 2.0-4.0% of Si, the balance being Co and inevitable impurities. The Co—W—Cr—C alloy preferably comprises by mass 3.0-10.0% of W, 25.0-31.0% of Cr, and 1.0-2.0% of C, the balance being Co and inevitable impurities. The hard particles preferably have Vickers hardness of 500-800 HV0.1, in an amount of 30-70% by mass.

The method of the present invention for producing a sintered valve seat having hard Co-based alloy particles dispersed in a Cu matrix comprises the steps of compressing, molding and sintering a mixed powder of Cu powder, alloy element powder and the hard particles; the Cu powder having an average particle size of 45 μm or less and purity of 99.5% or more; and the alloy element powder being Fe—P alloy powder.

The sintering temperature is preferably 850-1070° C.

Effects of the Invention

Because fine Cu powder is used for the sintered valve seat of the present invention, a network-like Cu matrix can be formed even though a relatively large amount, for example, more than 50% by mass, of hard particles are contained. Also, densification by liquid-phase sintering can provide excellent wear resistance while keeping high thermal conductivity, resulting in improved valve coolability. As a result, the abnormal combustion such as knocking, etc. of engines can be reduced, contributing to improvement in the performance of high-compression-ratio, high-efficiency engines.

BRIEF DESCRIPTION OF THE DRAWINGS

FIG. 3(*b*) is a Cr-Kα image by EPMA of the microscopic structure of FIG. 2.

FIG. 3(*c*) is a Co-Kα image by EPMA of the microscopic structure of FIG. 2.

FIG. 3(*d*) is a Mo-Kα image by EPMA of the microscopic structure of FIG. 2.

FIG. 3(*e*) is a P-Kα image by EPMA of the microscopic structure of FIG. 2.

FIG. 3(*f*) is an Fe-Kα image by EPMA of the microscopic structure of FIG. 2.

FIG. 3(*g*) is a Cu-Kα image by EPMA of the microscopic structure of FIG. 2.

DESCRIPTION OF THE PREFERRED EMBODIMENTS

Figure 1:
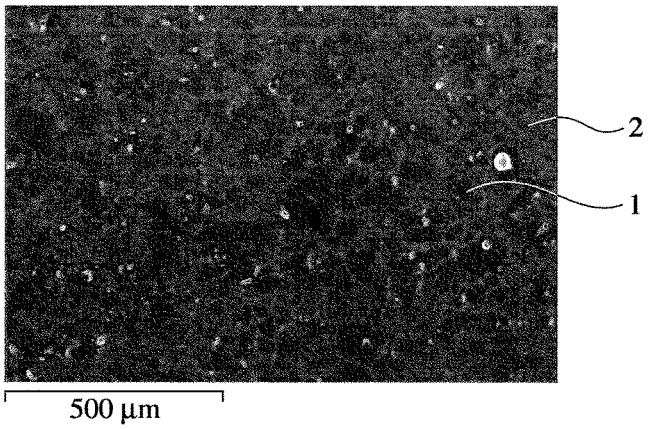
FIG. 1 is a SEM photograph showing the microscopic structure of the sintered valve seat of Example 1.

The sintered valve seat of the present invention has a structure in which hard Co-based alloy particles are dispersed in a Cu matrix, and contains by mass 2.1-6.0% of Fe and 0.8-2.2% of P in addition to components forming the Cu matrix and the hard particles. Fe and P are alloy elements mainly derived from Fe—P alloy powder added for liquid-phase sintering to make the sintered body denser. Less than 2.1% of Fe or less than 0.8% of P cannot provide sufficient densification. On the other hand, when Fe is more than 6.0%, or when P is more than 2.2%, they are more diffused in hard Co-based alloy particles, so that the hard particles are deteriorated. Accordingly, Fe is 2.1-6.0%, and P is 0.8-2.2%. Though Ni may be added to improve the matrix strength, it forms a solid solution with Cu, resulting in low thermal conductivity. Accordingly, the upper limit of Ni is 5.0%. Ni powder preferably has an average particle size of 3-7 μm, and purity of 99.5% or more.

The hard Co-based alloy particles dispersed in a Cu matrix are not substantially dissolved in Cu at 500° C. or lower. This Co-based alloy is preferably a Co-based alloy such as Stellite (registered trademark) and Tribaloy (registered trademark), which contains Mo, Cr, W, etc. not substantially dissolved in Cu. Specifically, Co—Mo—Cr—Si alloys comprising by mass 27.5-30.0% of Mo, 7.5-10.0% of Cr, and 2.0-4.0% of Si, the balance being Co and inevitable impurities, which are commercially available as Tribaloy (registered trademark) T-400; and Co—W—Cr—C alloys comprising by mass 3.0-10.0% of W, 25.0-31.0% of Cr, and 1.0-2.0% of C, the balance being Co and inevitable impurities, which are commercially available as Stellite (registered trademark) #6 and #12, are conveniently usable.

The average particle size of the hard particles is preferably 5-100 μm, more preferably 20-95 μm, further preferably 25-90 μm. To secure wear resistance, the Vickers hardness of the hard particles is preferably 500-800 HV0.1, more preferably 600-800 HV0.1, further preferably 650-800 HV0.1. The amount of the hard particles dispersed in a Cu matrix is preferably 30-70% by mass, more preferably 40-70% by mass, further preferably more than 50% by mass and 65% by mass or less. With the above hard particles dispersed in a Cu matrix, the sintered valve seat of the present invention has Rockwell hardness of preferably 50-90 HRB, more preferably 55-85 HRB, further preferably 60-80 HRB.

The production method of the sintered valve seat of the present invention uses Cu powder having an average particle size of 45 μm or less and purity of 99.5% or more. For sufficient filling of the powder, Cu powder having a smaller average particle size than that of the hard particles is used, so that a network-connected Cu matrix can be formed even with a relatively large amount of the hard particles. For example, the hard particles preferably have an average particle size of 30 μm or more, and Cu powder preferably has an average particle size of 20 μm or less. Cu powder is preferably atomized spherical powder. Dendritic electrolytic Cu powder having fine projections for tangling is also preferably usable to form a network-connected matrix.

To densify the sintered body, Fe—P alloy powder and/or Ni—P alloy powder may be used. Because the Fe—P alloy and the Ni—P alloy have eutectic points of 1048° C. and 870° C., respectively, the use of Ni—P alloy powder is preferable from the aspect of liquid-phase sintering. On the other hand, because Ni lowers the thermal conductivity by forming a solid solution with Cu at any ratio, the use of the Fe—P alloy powder, alloy powder of Fe substantially not dissolved in Cu at 500° C. or lower, is preferable from the aspect of thermal conductivity. As a result, Fe and P are easily dissolved in Co and diffused in hard Co-based alloy particles, keeping the purity of the Cu matrix.

The method of the present invention for producing a sintered valve seat comprises the steps of compressing, molding and sintering a mixed powder of Cu powder, Fe—P alloy powder, and hard Co-based alloy particles. To enhance moldability, 0.5-2% by mass of stearate may be added as a parting agent to the mixed powder. The compression-molded powder is sintered at a temperature of 850-1070° C. in vacuum or in a non-oxidizing or reducing atmosphere.

Example 1

Electrolytic Cu powder having an average particle size of 22 μm and purity of 99.8% was mixed with 52% by mass of Co—Mo—Cr—Si alloy powder having an average particle size of 29 which comprised by mass 28.5% of Mo, 8.5% of Cr, and 2.6% of Si, the balance being Co and inevitable impurities, as hard particles, and 3% by mass of Fe—P alloy powder containing 26.7% by mass of P as a sintering aid, and blended in a blender to prepare a mixed powder. To achieve good parting from a die in the molding step, 0.5% by mass of zinc stearate was added to the starting material powder.

The mixed powder was charged into a molding die, compression-molded by pressing at 640 MPa, and sintered at 1050° C. in vacuum to produce a ring-shaped sintered body having an outer diameter of 37.6 mm, an inner diameter of 21.5 mm and a thickness of 8 mm. The sintered body was machined to form a valve seat sample of 26.3 mm in outer diameter, 22.1 mm in inner diameter and 6 mm in height, which had a face surface inclined by 45° from the axial direction. The sintered body had Rockwell hardness of 60.5 HRB. Chemical analysis revealed that the valve seat contained 2.2% of Fe, and 0.8% of P.

Figure 2:
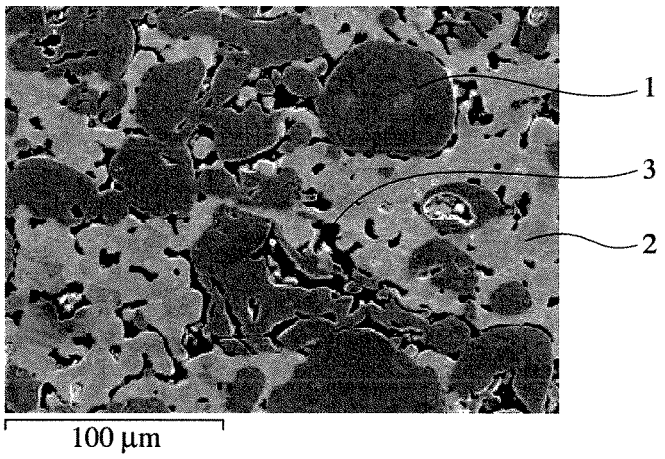
FIG. 2 is a SEM photograph enlargedly showing the microscopic structure of the sintered valve seat of Example 1.
Figure 3A:
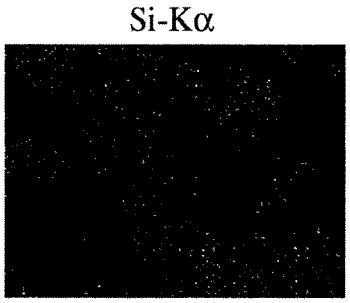
FIG. 3(*a*) is a Si-Kα image by EPMA of the microscopic structure of FIG. 2.
Figure 3B:
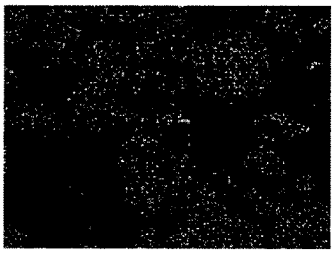
Figure 3C:
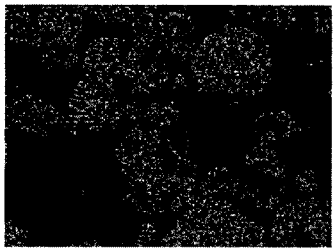
Figure 3D:
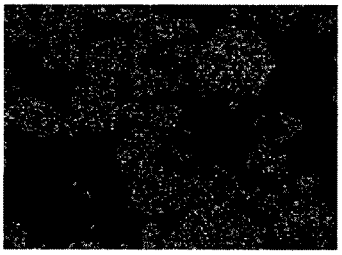
Figure 3E:
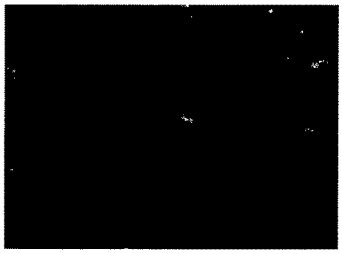
Figure 3F:
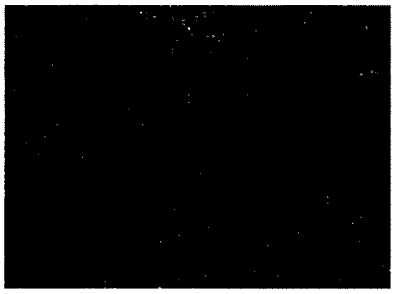
Figure 3G:
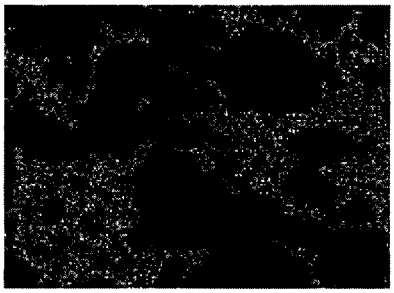

FIGS. 1 and 2 are scanning electron photomicrographs (SEM photographs) showing a cross-sectional structure of the sintered body of Example 1. The sintered body comprised hard Co-based alloy particles 1 (dark color), a Cu matrix 2 (brighter gray than hard particles 1), and pores 3 (black), and was free from large defects despite incomplete densification. The Cu matrix 2 was continuous in the entire structure, mostly in close contact with the hard particles 1. The hard particles 1 had Vickers hardness of 715 HV0.1.

FIGS. 3(*a*) to 3(*g*) show the characteristic X-ray images of the structure of FIG. 2, FIG. 3(*a*) showing a Si-Kα image, FIG. 3(*b*) showing a Cr-Kα image, FIG. 3(*c*) showing a Co-Kα image, FIG. 3(*d*) showing a Mo-Kα image, FIG. 3(*e*) showing a P-Kα image, FIG. 3(*f*) showing an Fe-Kα image, and FIG. 3(*g*) showing a Cu-Kα image. The P-Kα image of FIG. 3(*e*) shows a few Fe—P alloy powder portions remaining in the matrix, and the Fe-Kα image of FIG. 3(*f*) shows that Fe was diffused not in the Cu matrix 2 but in the hard Co-based alloy particles 1.

Example 2

A valve seat sample was produced in the same manner as in Example 1, except that 7% by mass of Fe—P alloy powder was used as a sintering aid. The sintered body had Rockwell hardness of 71.5 HRB. Chemical analysis revealed that the valve seat contained 5.2% of Fe, and 1.9% of P.

Figure 4:
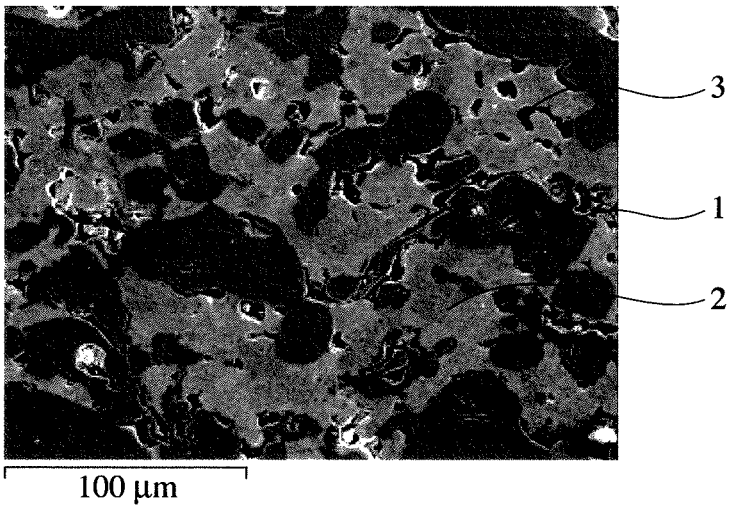
FIG. 4 is a SEM photograph enlargedly showing the microscopic structure of the sintered valve seat of Example 2.

FIG. 4 is a scanning electron photomicrograph (SEM photograph) showing a cross-sectional structure of the sintered body of Example 2. It was found that the sintered body of Example 2 was much denser than that of Example 1, with higher communication of the Cu matrix. Though not depicted, the P-Kα image and the Fe-Kα image show that P and Fe were diffused not in the Cu matrix 2 but in the hard Co-based alloy particles 1, and more in finer hard Co-based alloy particles 1. The hard particles 1 had Vickers hardness of 679 HV0.1.

Comparative Example 1

A valve seat sample having the same shape as in Example 1 was produced, using a sintered Fe-based alloy containing 10% by mass of hard Fe—Mo—Si alloy particles. The sintered body had Rockwell hardness of 90.5 HRB.

[1] Measurement of Valve Coolability (Valve Temperature)

Figure 5:
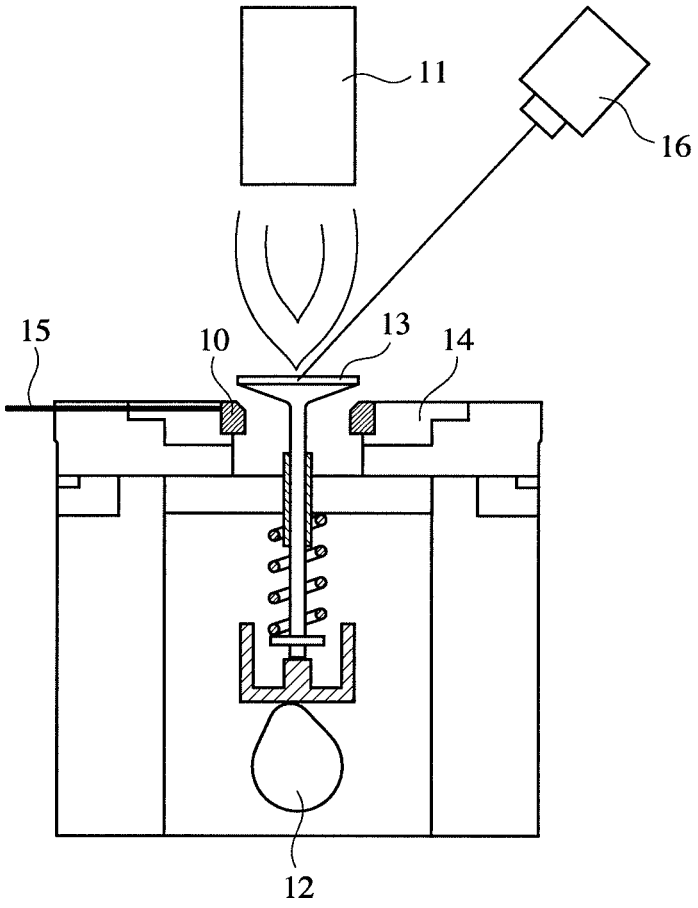
FIG. 5 is a schematic view showing a rig test machine.

The valve temperature was measured by a rig test machine shown in FIG. 5, to evaluate valve coolability. The valve seat sample 10 was press-fit into a valve seat holder 14 made of the same Al alloy (AC4A) as that of a cylinder head, and set in the test machine. The rig test was conducted by moving a valve 13 (SUH alloy, JIS G4311) up and down by rotating a cam 12 while heating the valve 13 by a burner 11. The valve coolability was determined by measuring the temperature of a valve head center by a thermograph 16, with a constant heat input by constant flow rates of air and a gas from the burner 11 and a constant position of the burner. The flow rates of air and a gas from the burner 11 were 90 L/min and 5.0 L/min, respectively, and the rotation number of the cam was 2500 rpm. 15 minutes after starting the operation, a saturated valve temperature was measured. In Examples, the valve coolability was evaluated by temperature decrease (expressed by "−") from the valve temperature in Comparative Example 1, in place of the saturated valve temperature variable depending on heating conditions, etc. Though the saturated valve temperature was higher than 800° C. in Comparative Example 1, the saturated valve temperatures in Examples 1 and 2 were lower than 800° C., resulting in the valve coolability of −48° C. and −32° C., respectively.

[2] Wear Test

After the evaluation of valve coolability, the wear resistance was evaluated by a thermocouple 15 embedded in the valve seat 10 in the rig test machine shown in FIG. 5, with the burner 11 adjusted to heat a contact surface of the valve seat to a predetermined temperature. The amount of wear was expressed by a receding distance of the contact surface determined by measuring the shapes of the valve seat and the valve before and after the test. The valve 13 (SUH alloy) had a Co alloy (Co-20% Cr-8% W-1.35% C-3% Fe) buildup-welded to a size fit into the above valve seat. The test conditions were a temperature of 300° C. on the contact surface of the valve seat, a cam rotation number of 2500 rpm, and a test time of 5 hours. The amount of wear was expressed by a ratio to the amount of wear (=1) in Comparative Example 1. The amounts of wear in Examples 1 and 2 were 1.03 and 0.69 in the valve seat, and 1.02 and 0.83 in the valve, relative to Comparative Example 1.

Examples 3-6

In Examples 3-6, valve seat samples were produced in the same manner as in Example 1, except for using 28% by mass, 40% by mass, 55% by mass and 65% by mass, respectively, of hard particles, and 5% by mass of Fe—P alloy powder as a sintering aid. The chemical analysis of Fe and P, the measurement of Rockwell hardness and valve coolability, and the wear test were conducted in the same manner as in Example 1.

Comparative Examples 2 and 3

In Comparative Examples 2 and 3, valve seat samples were produced in the same manner as in Example 1, except for using 2.5% by mass and 8.5% by mass, respectively, of Fe—P alloy powder as a sintering aid. The chemical analysis of Fe and P, the measurement of Rockwell hardness and valve coolability, and the wear test were conducted in the same manner as in Example 1.

Examples 7 and 8

Valve seat samples were produced in the same manner as in Example 1, except for adding 2% by mass and 4% by mass, respectively, of Ni powder having an average particle size of 5.6 μm and purity of 99.7% to strengthen the matrix. The chemical analysis of Fe and P, the measurement of Rockwell hardness and valve coolability, and the wear test were conducted in the same manner as in Example 1.

Example 9

A valve seat sample was produced in the same manner as in Example 1, except for using Co—W—Cr—C alloy powder having an average particle size of 85 μm, and a composition comprising by mass 4.0% of W, 28.0% of Cr, and 1.1% of C, the balance being Co and inevitable impurities, as hard particles. The sintered body had Rockwell hardness of 60.0 HRB.

The results of Examples 3-9 and Comparative Examples 2 and 3 are shown in Tables 1 and 2, together with those of Examples 1 and 2 and Comparative Example 1.

TABLE 1

| No. | % by mass Fe | % by mass P | Ni (% by mass) | Hard Particles (% by mass) | Rockwell Hardness HRB |
|---|---|---|---|---|---|
| Example 1 | 2.2 | 0.8 | 0 | 52 | 60.5 |
| Example 2 | 5.2 | 1.9 | 0 | 52 | 71.5 |
| Example 3 | 3.7 | 1.2 | 0 | 28 | 51.5 |
| Example 4 | 3.7 | 1.2 | 0 | 40 | 56.2 |
| Example 5 | 3.8 | 1.3 | 0 | 55 | 64.5 |
| Example 6 | 3.8 | 1.3 | 0 | 65 | 78.3 |
| Example 7 | 2.2 | 0.8 | 2 | 52 | 62.1 |
| Example 8 | 2.2 | 0.8 | 4 | 52 | 64.3 |
| Example 9 | 2.2 | 0.8 | 0 | 52 | 60.0 |
| Com. Ex. 1 | — | — | | 10* | 90.5 |
| Com. Ex. 2 | 1.8 | 0.6 | 0 | 52 | 52.8 |
| Com. Ex. 3 | 6.2 | 2.4 | 0 | 52 | 73.7 |

Note:
*Hard particles in Comparative Example 1 were made of an Fe—Mo—Si alloy.

TABLE 2

| No. | Valve Coolability (° C.) | Amount of Wear Wear Test Seat (μm) | Amount of Wear Wear Test Valve (μm) |
|---|---|---|---|
| Example 1 | −48 | 1.03 | 1.02 |
| Example 2 | −32 | 0.69 | 0.83 |
| Example 3 | −54 | 1.2 | 0.91 |
| Example 4 | −50 | 1.1 | 0.82 |
| Example 5 | −40 | 0.76 | 0.88 |
| Example 6 | −28 | 0.93 | 0.95 |
| Example 7 | −37 | 0.75 | 0.96 |
| Example 8 | −25 | 0.74 | 0.95 |
| Example 9 | −47 | 1.10 | 1.09 |
| Com. Ex. 1 | — | 1 | 1 |
| Com. Ex. 2 | −10 | 3.8 | 1.05 |
| Com. Ex. 3 | −5 | 2.2 | 1.02 |

What is claimed is:

1. A sintered valve seat having hard Co-based alloy particles dispersed in a Cu matrix; said sintered valve seat comprising by mass 2.1-6.0% of Fe and 0.8-2.2% of P, in addition to components forming said Cu matrix and said hard particles, wherein said hard particles have an average particle size of 5-100 μm, said hard particles are in an amount of 30-70% by mass, and said hard particles are made of a Co—Mo—Cr—Si alloy or a Co—W—Cr—C alloy, said Co—Mo—Cr—Si alloy comprising by mass 27.5-30.0% of Mo, 7.5-10.0% of Cr, and 2.0-4.0% of Si, the balance being Co and inevitable impurities, and said Co—W—Cr—C alloy comprising by mass 3.0-10.0% of W, 25.0-31.0% of Cr, and 1.0-2.0% of C, the balance being Co and inevitable impurities.

2. The sintered valve seat according to claim 1, which further comprises 5% or less by mass of Ni.

3. The sintered valve seat according to claim 1, wherein said hard particles have Vickers hardness of 500-800 HV0.1.

4. A method for producing a sintered valve seat of claim 1, comprising the steps of compressing, molding and sintering a mixed powder of Cu powder, alloy element powder and said hard particles; said Cu powder having an average particle size of 45 μm or less and purity of 99.5% or more; and said alloy element powder being an Fe—P alloy powder.

5. The method for producing a sintered valve according to claim 4, wherein said Cu powder is electrolytic Cu powder.

6. The method for producing a sintered valve according to claim 4, wherein the temperature of said sintering step is 850-1070° C.

* * * * *